US008591385B2

(12) United States Patent
Wang

(10) Patent No.: US 8,591,385 B2
(45) **Date of Patent: *Nov. 26, 2013**

(54) REHABILITATION EXERCISING EQUIPMENT THAT CAN EXTEND A USER'S LEGS

(75) Inventor: Shih-Jung Wang, Taiping (TW)

(73) Assignee: Preventive Medical Health Care Co., Ltd., Taoyuan County (TW)

( * ) Notice: Subject to any disclaimer, the term of this patent is extended or adjusted under 35 U.S.C. 154(b) by 198 days.

This patent is subject to a terminal disclaimer.

(21) Appl. No.: 13/171,692

(22) Filed: Jun. 29, 2011

(65) Prior Publication Data

US 2013/0005549 A1 Jan. 3, 2013

(51) Int. Cl.

| | |
|---|---|
| ***A63B 22/00*** | (2006.01) |
| ***A63B 71/00*** | (2006.01) |
| ***A63B 22/06*** | (2006.01) |
| ***A63B 69/12*** | (2006.01) |

(52) U.S. Cl.

USPC ..... 482/51; 482/57

(58) Field of Classification Search

USPC ..... 482/51–52, 57, 62–63, 92, 133–138, 482/148; 601/23, 33–36

See application file for complete search history.

(56) References Cited

U.S. PATENT DOCUMENTS

| | | | | |
|---|---|---|---|---|
| 3,213,852 | A * | 10/1965 | Zent | 601/36 |
| 5,310,392 | A * | 5/1994 | Lo | 482/63 |
| 6,852,070 | B1 * | 2/2005 | Herbert | 482/57 |
| 2010/0130331 | A1 * | 5/2010 | Hu | 482/57 |

* cited by examiner

*Primary Examiner* — Loan Thanh

*Assistant Examiner* — Jennifer M Deichl

(74) *Attorney, Agent, or Firm* — Alan Kamrath; Kamrath IP Lawfirm, P.A.

(57) ABSTRACT

Rehabilitation exercising equipment includes a main frame, a seat unit mounted on the main frame, a first geared member rotatably mounted on the main frame, a second geared member rotatably mounted on the main frame, a connecting mechanism mounted between the first geared member and the second geared member to connect the first geared member and the second geared member, and two pivot mechanisms connected with the first geared member and the second geared member. Thus, when the two pivot mechanisms are driven by the user's feet, the two pivot mechanisms are pivoted forward and backward relative to the main frame in two opposite directions by connection of the connecting mechanism so as to exercise or rehabilitate the user's legs, thereby achieving an exercising or rehabilitating function.

16 Claims, 11 Drawing Sheets

REHABILITATION EXERCISING EQUIPMENT THAT CAN EXTEND A USER'S LEGS

BACKGROUND OF THE INVENTION

1. Fieled of the Invention

The present invention relates to rehabilitation equipment and, more particularly, to a rehabilitation exercising equipment.

2. Description of the Related Art

Conventional rehabilitation equipment comprises a support frame, a pedal portion mounted on the support frame, and a handle portion mounted on the support frame and connected with the pedal portion to move in concert with the pedal portion. Thus, when a user holds the handle portion and treads the pedal portion, the handle portion is driven by the pedal portion to move upward and downward so as to provide a rehabilitating function to the user's two hands. However, when the user's legs are injured, he/she cannot tread the pedal portion to drive the handle portion easily, thereby causing inconvenience to the user, and thereby decreasing the rehabilitating effect of the rehabilitation equipment.

A conventional exercising bike is available for a user to provide an exercising or rehabilitating function so that the user can exercise his/her two legs. However, the user has to tread and move the pedals along a circular track so that when the user's legs are injured, he/she cannot finish the circular track easily, thereby causing disturbance to the user, and thereby decreasing the exercising or rehabilitating effect of the exercising bike.

BRIEF SUMMARY OF THE INVENTION

In accordance with the present invention, there is provided rehabilitation exercising equipment, comprising a main frame, a seat unit mounted on the main frame, a first geared member rotatably mounted on the main frame, a second geared member rotatably mounted on the main frame, a connecting mechanism mounted between the first geared member and the second geared member to connect the first geared member and the second geared member so that the first geared member and the second geared member are movable in concert with each other, and two pivot mechanisms connected with the first geared member and the second geared member to rotate in concert with the first geared member and the second geared member respectively.

The primary objective of the present invention is to provide rehabilitation exercising equipment that can extend a user's legs.

According to the primary advantage of the present invention, when the two pivot mechanisms are driven by the user's feet, the two pivot mechanisms are pivoted relative to the main frame in two opposite directions by connection of the connecting mechanism and are moved forward and backward in a reciprocal manner so as to exercise or rehabilitate the user's legs, thereby achieving an exercising or rehabilitating function.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
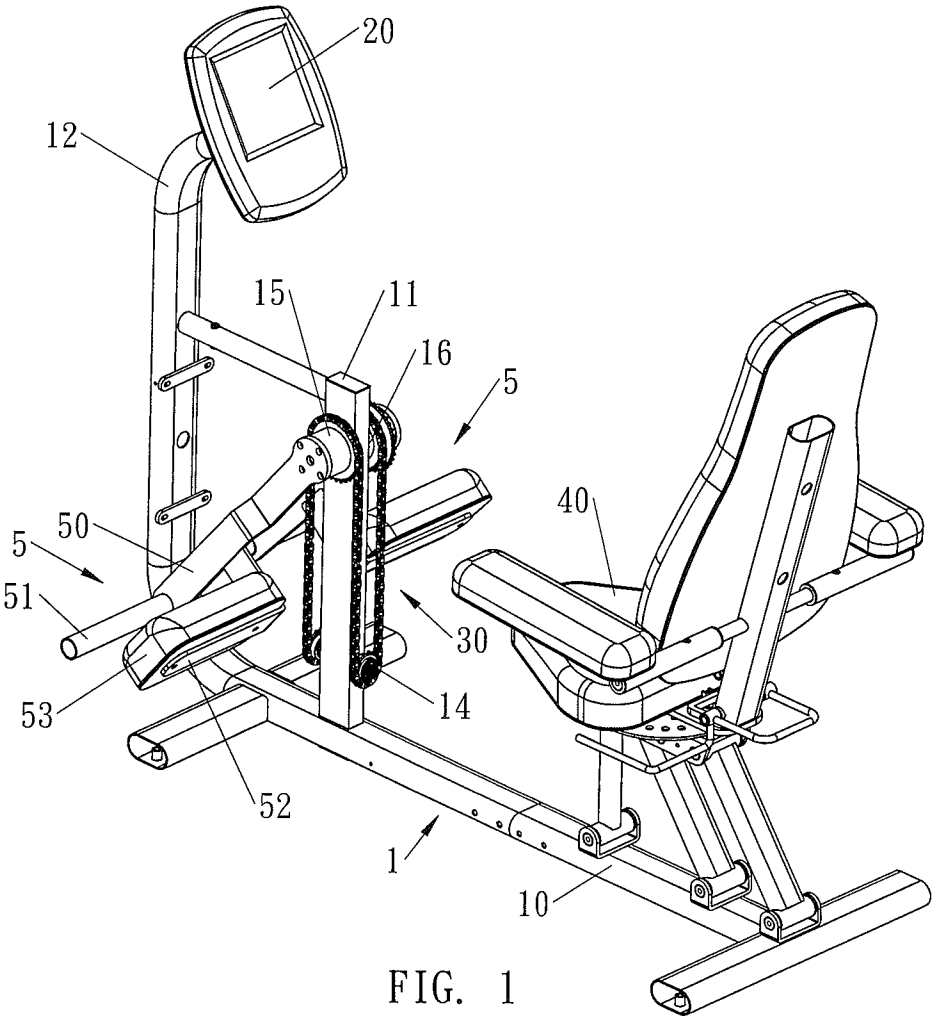
FIG. 1 is a perspective view of rehabilitation exercising equipment in accordance with the preferred embodiment of the present invention.

Referring to the drawings and initially to FIGS. 1-7, rehabilitation exercising equipment in accordance with the preferred embodiment of the present invention comprises a main frame 1, a seat unit 40 mounted on the main frame 1, a first geared member 15 rotatably mounted on the main frame 1, a second geared member 16 rotatably mounted on the main frame 1, a connecting mechanism 30 mounted between the first geared member 15 and the second geared member 16 to connect the first geared member 15 and the second geared member 16 so that the first geared member 15 and the second geared member 16 are movable in concert with each other, a first idle geared member 13 rotatably mounted on the main frame 1 and connected with the connecting mechanism 30, a second idle geared member 14 rotatably mounted on the main frame 1 and connected with the connecting mechanism 30, and two pivot mechanisms 5 connected with the first geared member 15 and the second geared member 16 to rotate in concert with the first geared member 15 and the second geared member 16 respectively.

The main frame 1 includes a transverse bar 10, an upright support post 11 mounted on the transverse bar 10, an extension bar 12 connected with the transverse bar 10, a crossbar 17 mounted between the support post 11 and the extension bar 12, and a control panel 20 mounted on the extension bar 12. The control panel 20 of the main frame 1 is preferably an electronic instrument panel.

The main frame 1 further includes a first support rod 113 mounted on the support post 11 to support the first geared member 15 and one of the two pivot mechanisms 5, a second support rod 114 mounted on the support post 11 to support the second geared member 16 and the other one of the two pivot mechanisms 5, a third support rod 111 mounted on the support post 11 to support the first idle geared member 13, and a fourth support rod 112 mounted on the support post 11 to support the second idle geared member 14.

The first geared member 15 and the second geared member 16 are parallel with each other and are rotated in two opposite directions by connection of the connecting mechanism 30. The first geared member 15 is rotatably mounted on the first support rod 113 of the support post 11. The second geared member 16 is rotatably mounted on the second support rod 114 of the support post 11. The first idle geared member 13 and the second idle geared member 14 are parallel with each other and are perpendicular to the first geared member 15 and the second geared member 16. The first idle geared member 13 and the second idle geared member 14 are located under the first geared member 15 and the second geared member 16. The first idle geared member 13 is rotatably mounted on the third support rod 111 of the support post 11. The second idle geared member 14 is rotatably mounted on the fourth support rod 112 of the support post 11.

The connecting mechanism 30 is connected between the first geared member 15, the second geared member 16, the first idle geared member 13 and the second idle geared member 14. The connecting mechanism 30 includes a first connecting portion 33 meshing with the first geared member 15, a second connecting portion 34 meshing with the second geared member 16, a third connecting portion 31 meshing with the first idle geared member 13 and a fourth connecting portion 32 meshing with the second idle geared member 14.

The first connecting portion 33 and the second connecting portion 34 of the connecting mechanism 30 are parallel with each other. Each of the first connecting portion 33 and the second connecting portion 34 of the connecting mechanism 30 has a substantially inverted U-shaped profile and has a first distal end connected with the third connecting portion 31 and a second distal end connected with the fourth connecting portion 32. The third connecting portion 31 and the fourth connecting portion 32 of the connecting mechanism 30 are parallel with each other. Each of the third connecting portion 31 and the fourth connecting portion 32 of the connecting mechanism 30 traverses and connects the first connecting portion 33 and the second connecting portion 34 so that the third connecting portion 31 and the fourth connecting portion 32 of the connecting mechanism 30 are perpendicular to the first connecting portion 33 and the second connecting portion 34. Each of the third connecting portion 31 and the fourth connecting portion 32 of the connecting mechanism 30 has a substantially U-shaped profile and has a first distal end connected with the first connecting portion 33 and a second distal end connected with the second connecting portion 34.

The two pivot mechanisms 5 are pivoted in two opposite directions by connection of the connecting mechanism 30. Each of the two pivot mechanisms 5 includes a pivot lever 50 having a first end connected with one of the first geared member 15 and the second geared member 16 to rotate in concert with one of the first geared member 15 and the second geared member 16, a pedal 51 mounted on a second end of the pivot lever 50, a mounting bracket 52 mounted on a mediate portion of the pivot lever 50, and a leg support cushion 53 mounted on the mounting bracket 52. The pedal 51 of each of the two pivot mechanisms 5 is a rod. The mounting bracket 52 of each of the two pivot mechanisms 5 has a substantially L-shaped profile.

In the preferred embodiment of the present invention, the connecting mechanism 30 is a toothed belt. Alternatively, each of the first geared member 15, the second geared member 16, the first idle geared member 13 and the second idle geared member 14 is a sprocket, while the connecting mechanism 30 is a chain meshing with the sprocket.

Figure 2:
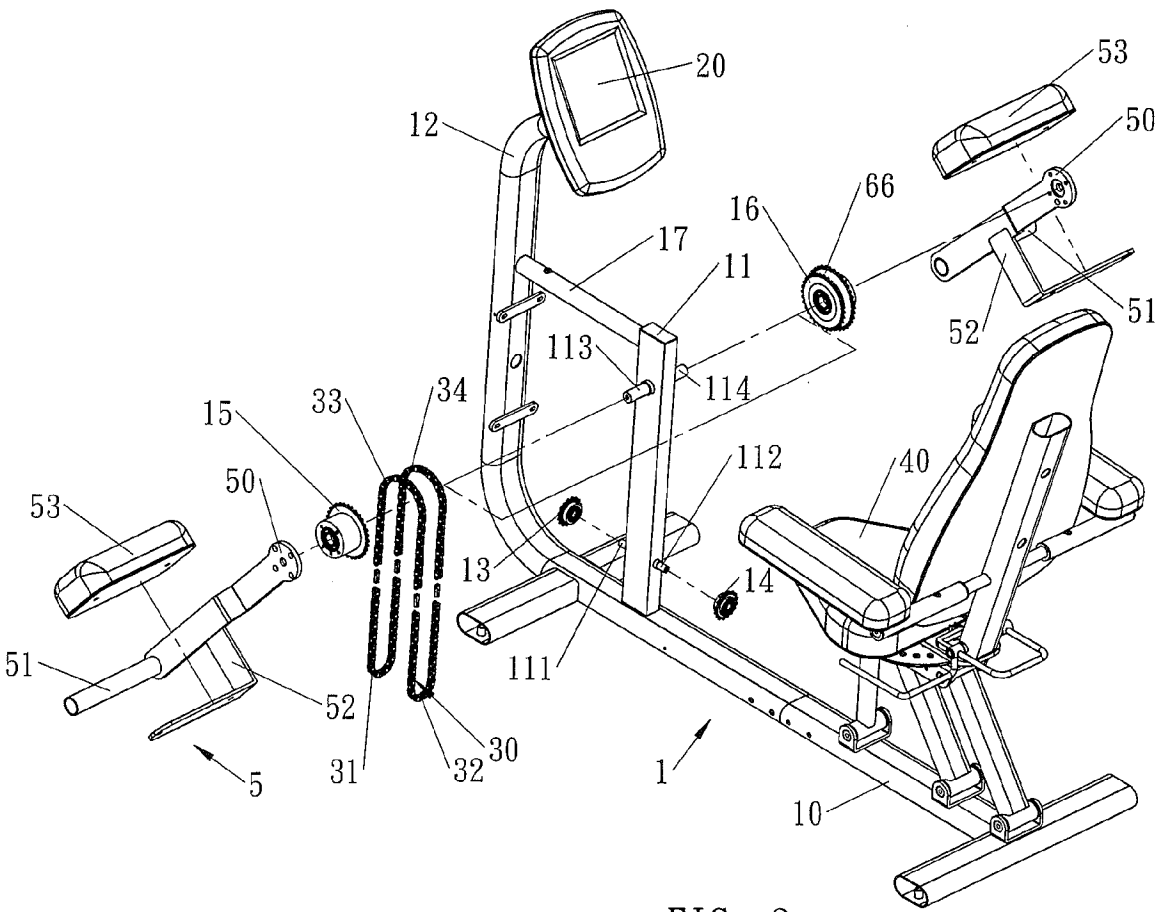
FIG. 2 is an exploded perspective view of the rehabilitation exercising equipment as shown in FIG. 1.
Figure 3:
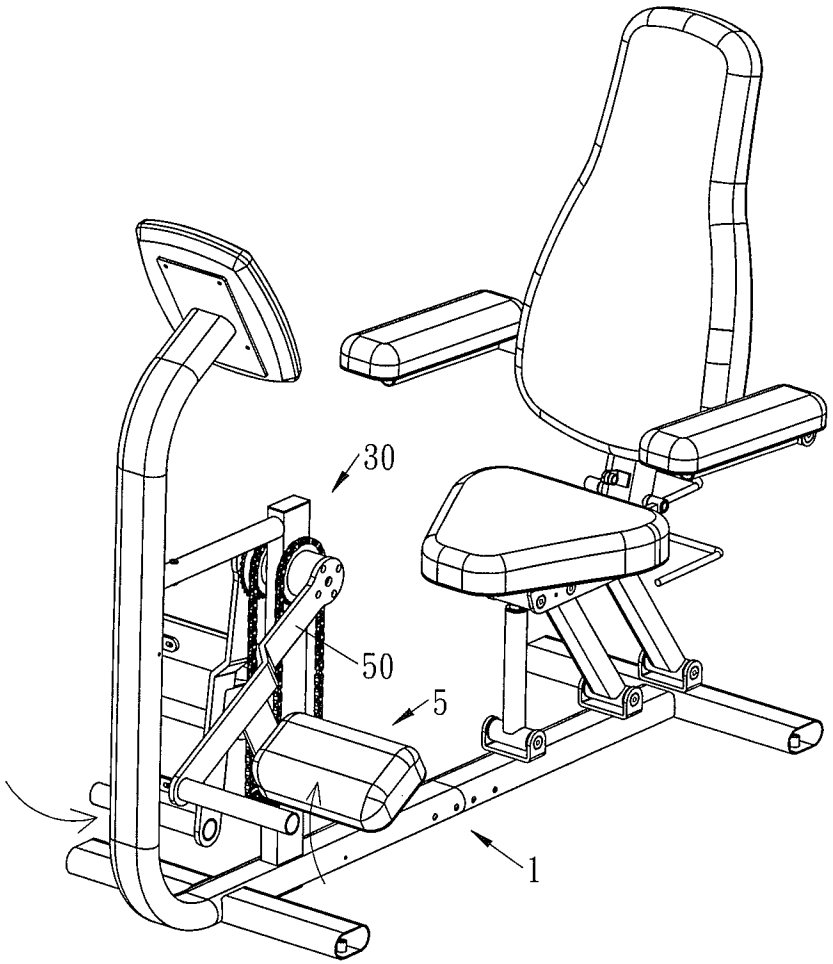
FIG. 3 is a perspective operational view of the rehabilitation exercising equipment as shown in FIG. 1.
Figure 4:
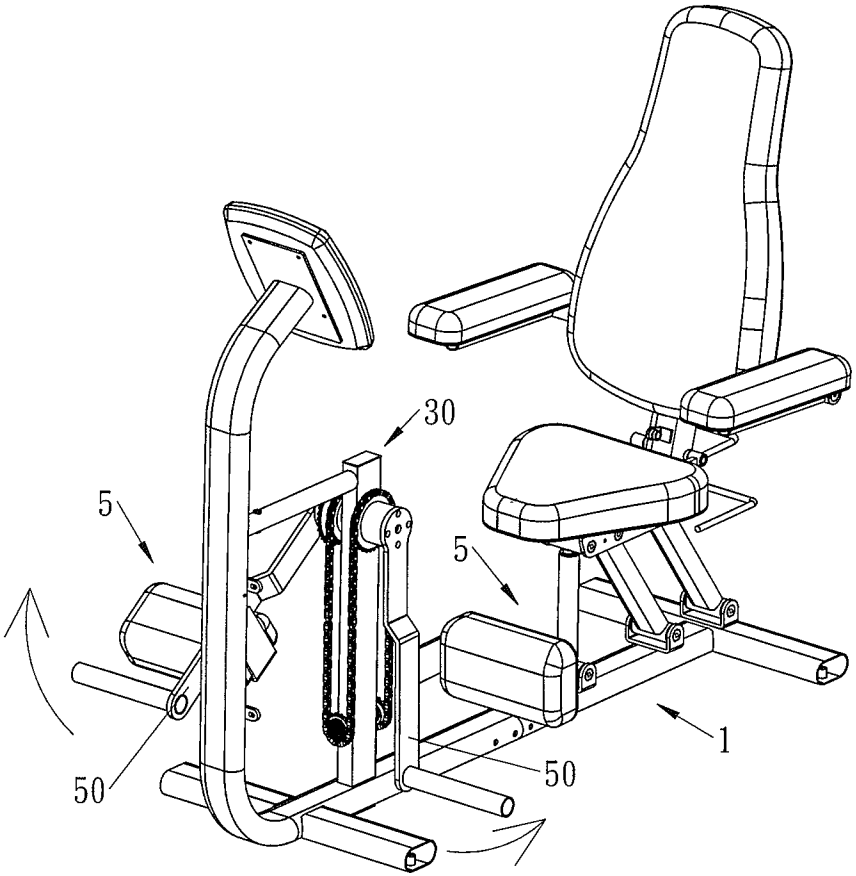
FIG. 4 is a perspective operational view of the rehabilitation exercising equipment as shown in FIG. 1.
Figure 5:
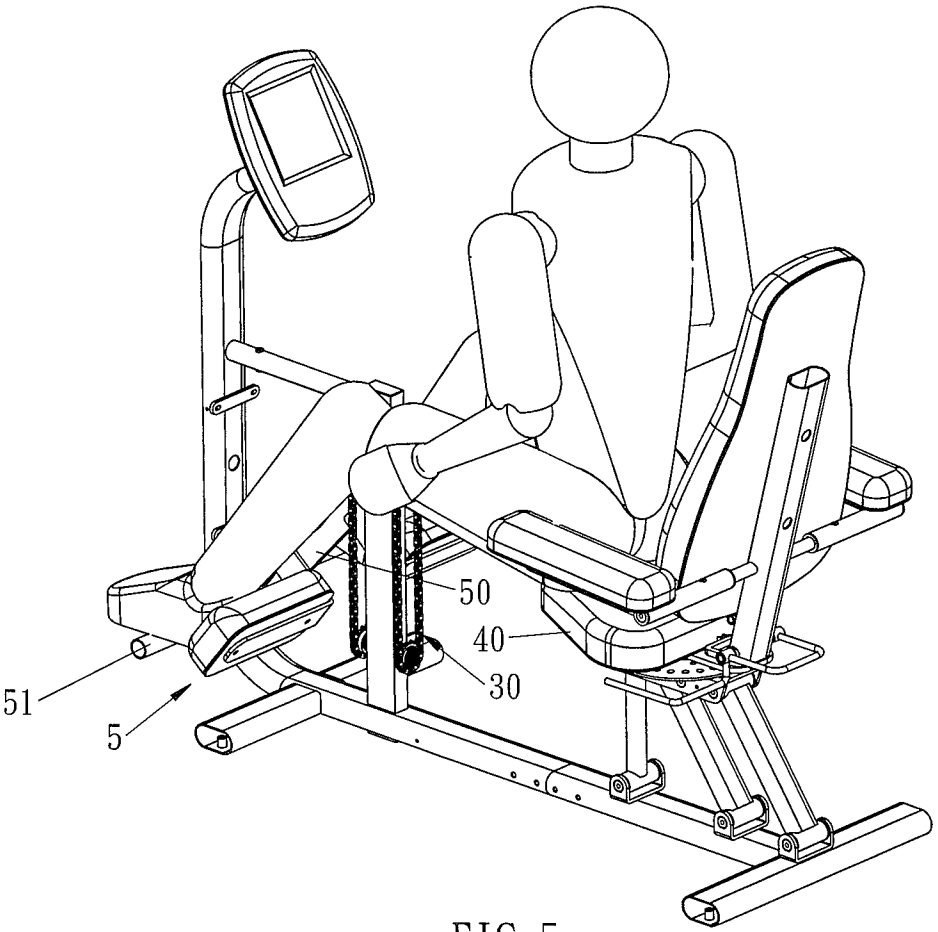
FIG. 5 is a perspective operational view of the rehabilitation exercising equipment as shown in FIG. 1.
Figure 6:
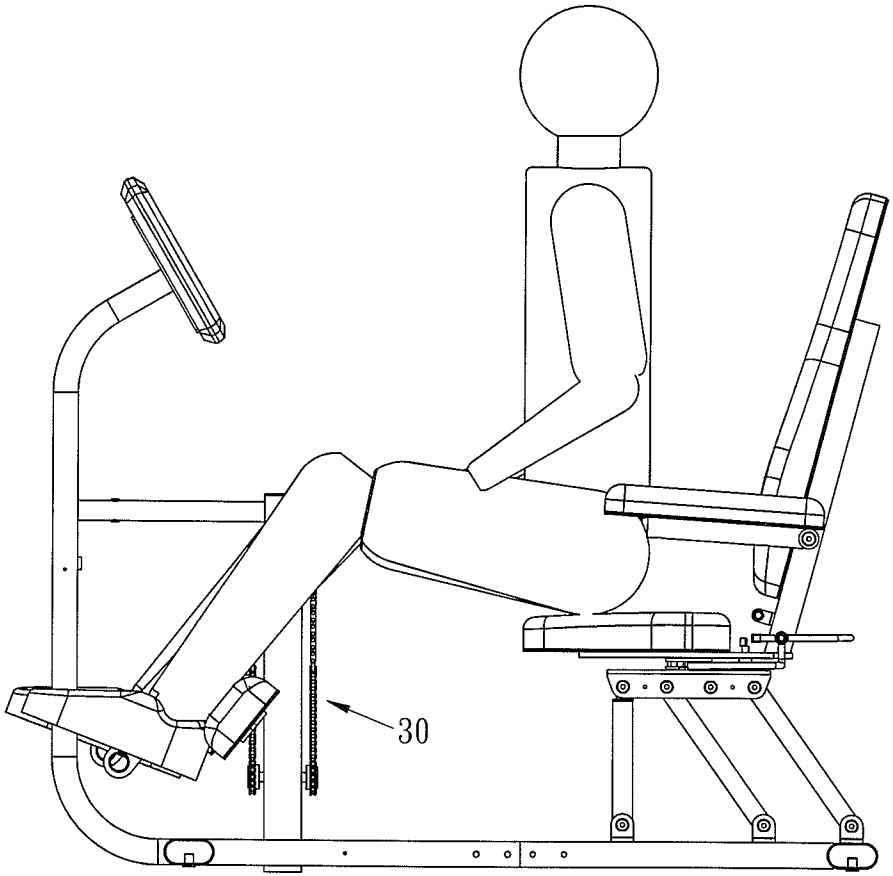
FIG. 6 is a side view of the rehabilitation exercising equipment as shown in FIG. 5.
Figure 7:
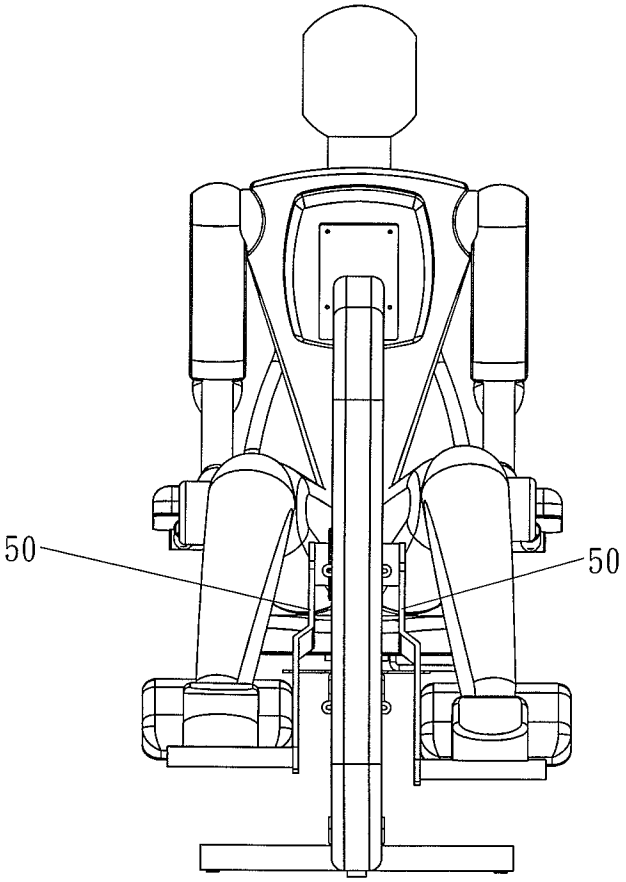
FIG. 7 is a front view of the rehabilitation exercising equipment as shown in FIG. 5.

In operation, referring to FIGS. 3-7 with reference to FIGS. 1 and 2, the connecting mechanism 30 is mounted between the first geared member 15, the second geared member 16, the first idle geared member 13 and the second idle geared member 14 so that the first geared member 15 and the second geared member 16 are moved in concert with each other and are moved in two opposite directions. In such a manner, the two pivot mechanisms 5 are pivoted about the support post 11 of the main frame 1 in two opposite directions as shown in FIGS. 3 and 4. Thus, when a user is seated on the seat unit 40, his/her two feet can tread the pedals 51 of the two pivot mechanisms 5 as shown in FIGS. 5-7 to move the two pivot mechanisms 5 forward and backward so that the two pivot mechanisms 5 are moved relative to the main frame 1 in two opposite directions by connection of the connecting mechanism 30 so as to exercise or rehabilitate the user's legs, thereby achieving an exercising or rehabilitating function.

Figure 8:
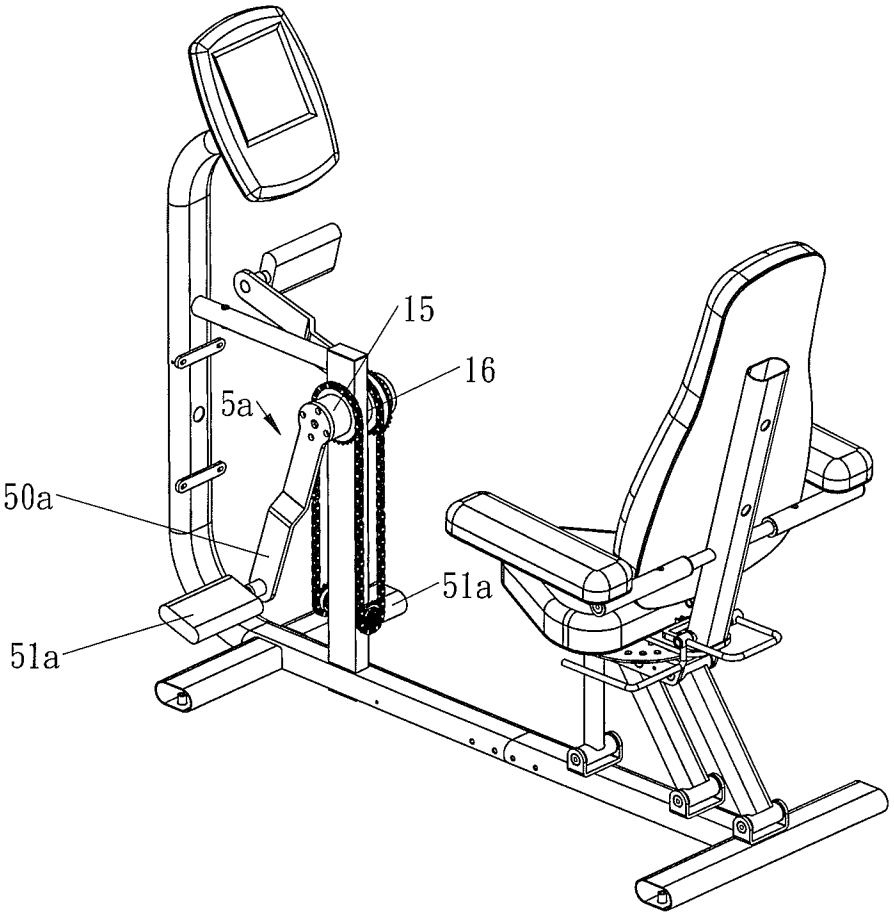
FIG. 8 is a perspective view of rehabilitation exercising equipment in accordance with another preferred embodiment of the present invention.
Figure 9:
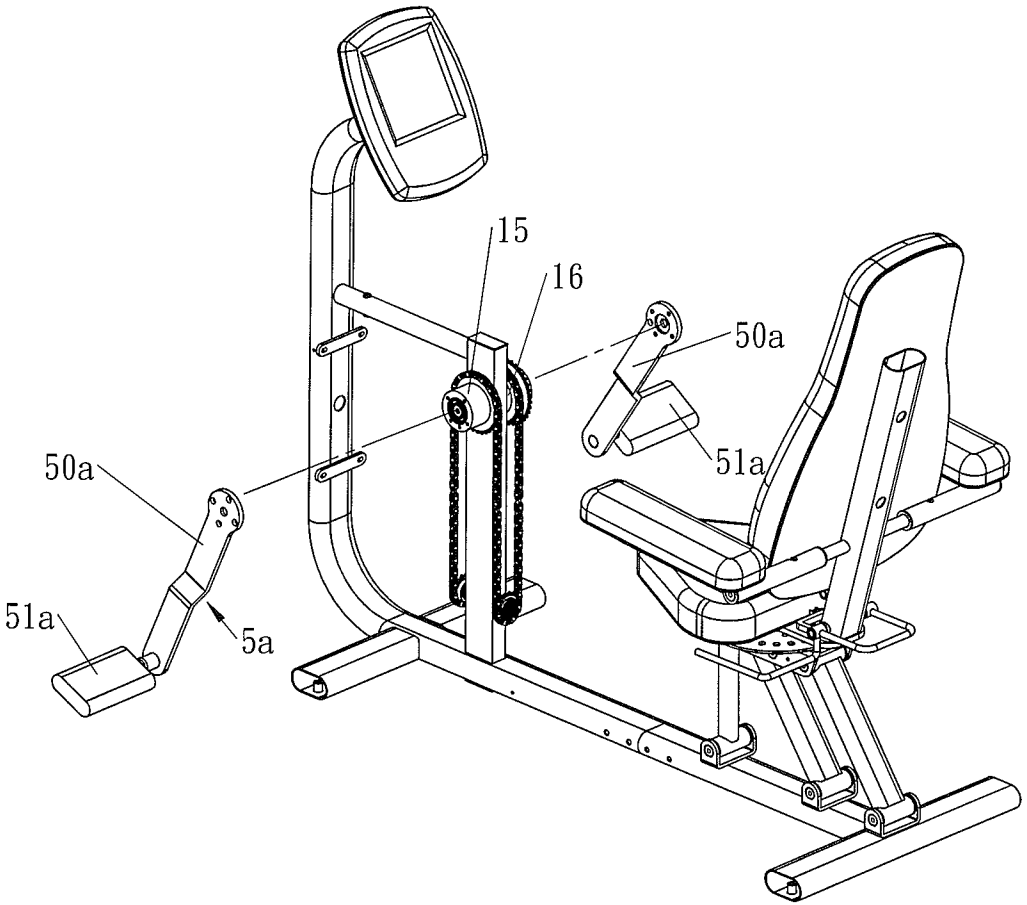
FIG. 9 is an exploded perspective view of the rehabilitation exercising equipment as shown in FIG. 8.

Referring to FIGS. 8 and 9, the pivot lever 50*a* of each of the two pivot mechanisms 5*a* is removably connected with one of the first geared member 15 and the second geared member 16, and the pedal 51*a* of each of the two pivot mechanisms 5*a* is a sheet plate.

Figure 10:
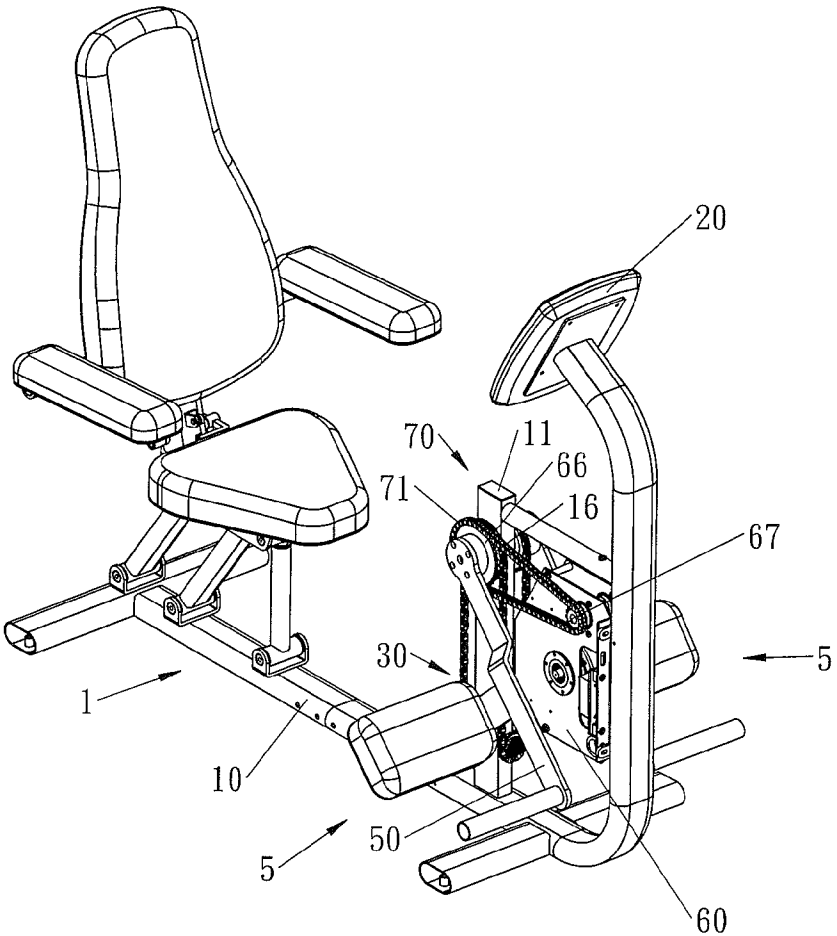
FIG. 10 is a perspective view of rehabilitation exercising equipment in accordance with another preferred embodiment of the present invention.
Figure 11:
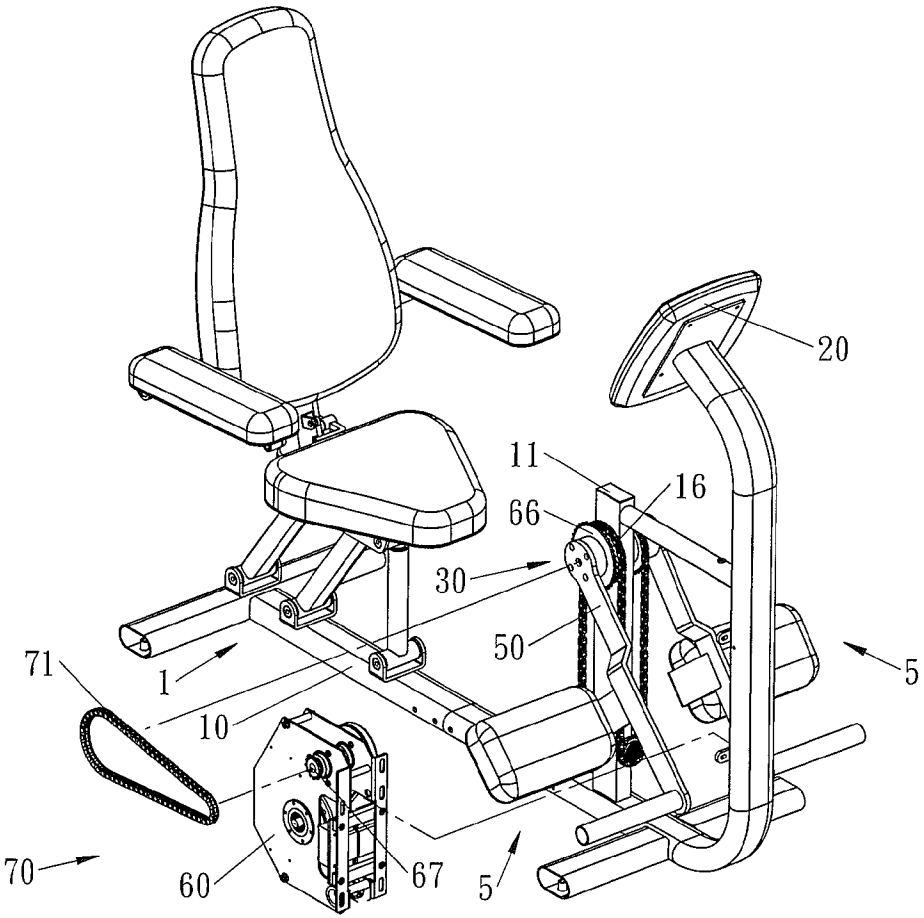
FIG. 11 is an exploded perspective view of the rehabilitation exercising equipment as shown in FIG. 10.

Referring to FIGS. 10 and 11, the rehabilitation exercising equipment further comprises a transmission mechanism 70 mounted between the main frame 1 and the second geared member 16. The transmission mechanism 70 includes a drive geared member 66 secured on the second geared member 16 to rotate in concert with the second geared member 16, a drive unit 60 mounted on the main frame 1, a driving geared member 67 rotatably mounted on the drive unit 60, and a linking member 71 mounted between the driving geared member 67 and the drive geared member 66 to link the driving geared member 67 and the drive geared member 66. The drive unit 60 of the transmission mechanism 70 is electrically connected to and controlled by the control panel 26 of the main frame 1.

In the preferred embodiment of the present invention, the drive unit 60 of the transmission mechanism 70 is a magnetically controlled resistance device. Alternatively, the drive unit 60 of the transmission mechanism 70 is a powered motor. In addition, the linking member 71 of the transmission mechanism 70 is a toothed belt. Alternatively, each of the driving geared member 67 and the drive geared member 66 of the transmission mechanism 70 is a sprocket, while the linking member 71 of the transmission mechanism 70 is a chain meshing with the sprocket.

In operation, when the drive unit 60 of the transmission mechanism 70 is a magnetically controlled resistance device, the drive unit 60 provides a damping force to the driving geared member 67 and the drive geared member 66 by connection of the linking member 71 to damp rotation of the second geared member 16 and to damp rotation of the first geared member 15 by connection of the connecting mechanism 30 so as to provide a resistance to the two pivot mechanisms 5 so that the user has to apply a larger force to tread and pivot the two pivot mechanisms 5 relative to the main frame 1, thereby enhancing the exercising or rehabilitating effect. At this time, the damping force of the drive unit 60 is controlled by the control panel 20 of the main frame 1.

Alternatively, when the drive unit 60 of the transmission mechanism 70 is a powered motor, the drive unit 60 drives the driving geared member 67 which drives the linking member 71 which drives the drive geared member 66 which drives the drive geared member 66 which drives the second geared member 16 which drives the connecting mechanism 30 which drives the first geared member 15 so that the two pivot mechanisms 5 are moved by the first geared member 15 and the second geared member 16 and are pivoted in two opposite directions by connection of the connecting mechanism 30 to move the user's two feet so as to achieve a rehabilitating function automatically.

Accordingly, when the two pivot mechanisms 5 are driven by the user's feet, the two pivot mechanisms 5 are pivoted relative to the main frame 1 in two opposite directions by connection of the connecting mechanism 30 and are moved forward and backward in a reciprocal manner so as to exercise or rehabilitate the user's legs, thereby achieving an exercising or rehabilitating function. In addition, the drive unit 60 of the transmission mechanism 70 functions as a magnetically controlled resistance device to provide a resistance to the two pivot mechanisms 5 so that the user has to apply a larger force to tread and pivot the two pivot mechanisms 5 relative to the main frame 1, thereby enhancing the exercising or rehabilitating effect. Further, the drive unit 60 of the transmission mechanism 70 functions as a powered motor to drive the two pivot mechanisms 5 relative to the main frame 1 and to move the user's two feet so as to achieve a rehabilitating function automatically.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. Rehabilitation exercising equipment, comprising:

a main frame;

a seat unit mounted on the main frame;

a first geared member rotatably mounted on the main frame;

a second geared member rotatably mounted on the main frame;

a connecting mechanism mounted between the first geared member and the second geared member to connect the first geared member and the second geared member so that the first geared member and the second geared member are movable in concert with each other;

two pivot mechanisms connected with the first geared member and the second geared member to rotate in concert with the first geared member and the second geared member respectively a first idle geared member rotatably mounted on the main flame and connected with the connecting mechanism; and a second idle geared member rotatably mounted on the main frame and connected with the connecting mechanism; wherein:

the connecting mechanism is connected between the first geared member, the second geared member, the first idle geared member and the second idle geared member;

the connecting, mechanism includes:

a first connecting portion meshing with the first geared member;

a second connecting portion meshing with the second geared member;

a third connecting portion meshing with the first idle geared member; and a fourth connecting portion meshing with the second idle geared member;

the first connecting portion and the second connecting portion of the connecting mechanism are parallel with each other;

the third connecting portion and the fourth connecting portion of the connecting mechanism are parallel with each other;

each of the third connecting portion and the fourth connecting portion of the connecting mechanism traverses and connects the first connecting portion and the second connecting portion;

the first connecting portion and the second connecting portion of the connecting mechanism are connected by the third connecting portion and the fourth connecting portion;

the third connecting portion and the fourth connecting portion of the connecting mechanism are perpendicular to the first connecting portion and the second connecting portion;

the pivot mechanisms respectively swing forward and backward in a reciprocal manner;

the pivot mechanisms cooperate to perform a non-cyclic reciprocal pivoting motion;

one of the pivot mechanisms drives the connecting mechanism which drives the other one of the pivot mechanisms.

2. The rehabilitation exercising equipment of claim 1, wherein each of the two pivot mechanisms includes:

a pivot lever having a first end connected with one of the first geared member and the second geared member to rotate in concert with one of the first geared member and the second geared member; and a pedal mounted on a second end of the pivot lever.

3. The rehabilitation exercising equipment of claim 2, wherein each of the two pivot mechanisms further includes a mounting bracket mounted on a mediate portion of the pivot lever.

4. The rehabilitation exercising equipment of claim 3, wherein the mounting bracket of each of the two pivot mechanisms has a substantially L-shaped profile.

5. The rehabilitation exercising equipment of claim 3, wherein each of the two pivot mechanisms further includes a leg support cushion mounted on the mounting bracket.

6. The rehabilitation exercising equipment of claim 2, wherein the pedal of each of the two pivot mechanisms is a rod.

7. The rehabilitation exercising equipment of claim 2, wherein the pedal of each of the two pivot mechanisms is a sheet plate.

8. The rehabilitation exercising equipment of claim 2, wherein the pivot lever of each of the two pivot mechanisms is removably connected with one of the first geared member and the second geared member.

9. The rehabilitation exercising equipment of claim 1, wherein the main frame includes:

a transverse bar;

an upright support post mounted on the transverse bar;

a first support rod mounted on the support post to support the first geared member and one of the two pivot mechanisms;

a second support rod mounted on the support post to support the second geared member and the other one of the two pivot mechanisms;

a third support rod mounted on the support post to support the first idle geared member; and a fourth support rod mounted on the support post to support the second idle geared member;

the first geared member is rotatably mounted on the first support rod of the support post;

the second geared member is rotatably mounted on the second support rod of the support post;

the first idle geared member is rotatably mounted on the third support rod of the support post;

the second idle geared member is rotatably mounted on the fourth support rod of the support post.

10. The rehabilitation exercising equipment of claim 1, wherein the connecting mechanism is a toothed belt.

11. The rehabilitation exercising equipment of claim 1, wherein each of the first geared member, the second geared member, the first idle geared member and the second idle geared member is a sprocket;

the connecting mechanism is a chain meshing with the sprocket.

12. The rehabilitation exercising equipment of claim 1, wherein the rehabilitation exercising equipment further comprises a transmission mechanism mounted between the main frame and the second geared member;

the transmission mechanism includes:

a drive geared member secured on the second geared member to rotate in concert with the second geared member;

a drive unit mounted on the main frame;

a driving geared member rotatably mounted on the drive unit; and a linking member mounted between the driving geared member and the drive geared member to link the driving geared member and the drive geared member.

13. The rehabilitation exercising equipment of claim 12, wherein the main frame includes:

a transverse bar;

an upright support post mounted on the transverse bar;

an extension bar connected with the transverse bar; and a control panel mounted on the extension bar;

the drive unit of the transmission mechanism is electrically connected to and controlled by the control panel of the main frame.

14. The rehabilitation exercising equipment of claim 12, wherein the drive unit of the transmission mechanism is a magnetically controlled resistance device.

15. The rehabilitation exercising equipment of claim 12, wherein the drive unit of the transmission mechanism is a powered motor.

16. The rehabilitation exercising equipment of claim 12, wherein the linking member of the transmission mechanism is a toothed belt.

* * * * *